United States Patent [19]

Sieweke et al.

[11] 4,216,946

[45] Aug. 12, 1980

[54] GATE ARRANGEMENT FOR COUNTERPRESSURE BLAST FURNACES

[75] Inventors: Wilhelm Sieweke, Dortmund; Hubert Nettler, Frönenberg; Jürgen Burmann, Hagen, all of Fed. Rep. of Germany

[73] Assignee: Paul Wurth S.A., Luxembourg, Luxembourg

[21] Appl. No.: 59,279

[22] Filed: Jul. 20, 1979

[30] Foreign Application Priority Data

Jul. 24, 1978 [DE] Fed. Rep. of Germany ..... 2832476

[51] Int. Cl.[3] ..... F27B 11/12

[52] U.S. Cl. ..... 266/87; 266/176; 266/197; 414/202

[58] Field of Search ..... 266/176, 87; 414/202

[56] References Cited

U.S. PATENT DOCUMENTS 3,955,693 5/1976 Legille et al. ..... 266/176

*Primary Examiner*—M. J. Andrews

*Attorney, Agent, or Firm*—Becker & Becker, Inc.

[57] ABSTRACT

A gate arrangement, especially for counterpressure blast furnaces, including a seal lid having an annular soft seal-insert and a steel seal-ring arranged at the lower end of the gate, which corresponds to the soft seal-insert. The arrangement also includes heating means operatively connectible to the steel seal-ring about its periphery.

6 Claims, 1 Drawing Figure

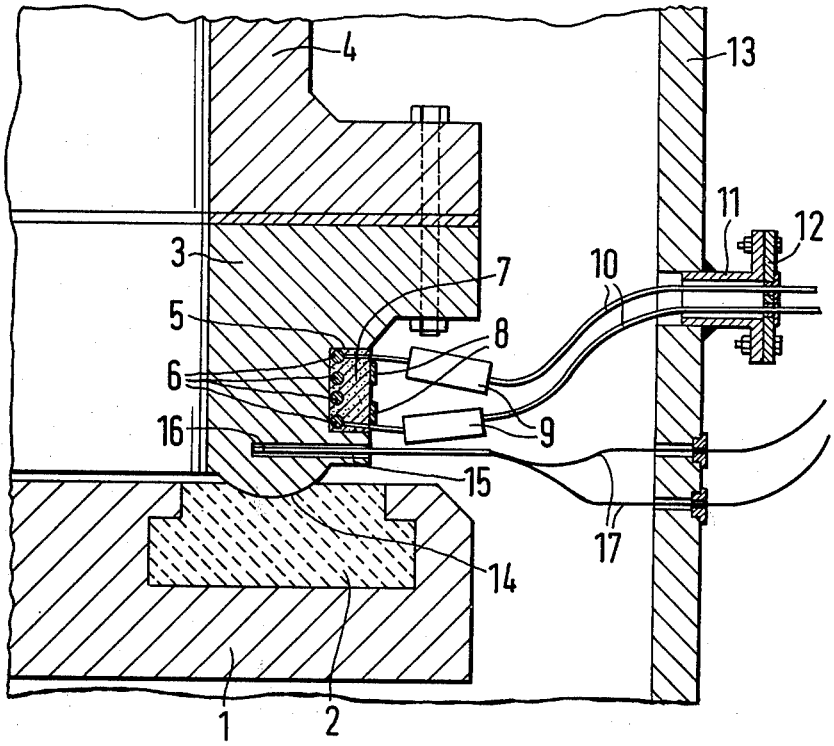
4
13
11
12
3
7
10
5
8
6
9
16
15
17
14
1
2

GATE ARRANGEMENT FOR COUNTERPRESSURE BLAST FURNACES

The present invention relates to a gate arrangement for counterpressure or back-pressure blast furnaces which arrangement includes a seal flap, lid or cover having an annular soft seal-insert and having a steel seal-ring provided at the lower end of the gate which steel seal-ring corresponds to the soft seal-insert.

Counterpressure blast furnaces can only be charged by means of gates and after equalization of pressure. Sealing of gates in known counterpressure blast furnaces is provided by seal lids having annular soft seal-inserts which are pressed against corresponding steel seal-rings at the lower ends of the gates. When a moist gas in the furnace head or furnace port forms a condensate on the steel seal-ring, this causes dust to become "baked on" or the formation of clinkers on this ring. Such clinker formation leads to destruction of the effective seal in the shortest period of time and to wear of the soft seal-inserts, the steel seal-ring and even the seal lid or flap proper, so that the blast furnace will be idle for the duration of repair work.

It is, accordingly, an object of the invention to provide a gate arrangement which avoids clinker formation of the dust at the steel seal-ring and, thereby, assures a permanent and secure closure of the seal lid so that down-time for the repair of the seal lid is substantially avoided.

This object and other objects and advantages of the invention will appear more clearly from the following specification in connection with the accompanying drawings, in which the sole FIGURE is a diagrammatic representation, in cross-section, showing one embodiment of the arrangement in accordance with the present invention.

The arrangement according to the invention is characterized primarily therein that heating means are arranged about the outer periphery of the steel seal-ring.

In accordance with one preferred embodiment of the invention, the heating means are embedded in an annular groove at the outer periphery of the steel seal-ring.

In accordance with a particularly preferred embodiment of the invention, the heating means include metal-coated heating cables which are embedded in a heat conducting cement.

For securing the position thereof, the heating elements are additionally held by a peripheral clamping band. For control by means of an electronic control system and for continuously monitoring the temperature at the arrangement, temperature sensors are provided in bores in the steel seal-ring, preferably between the heating elements.

This and other objects and advantages of the present invention, will appear more clearly from the following specification in connection with the accompanying drawing in which:

The FIGURE of the drawing shows a cross sectioned diagrammatic view of a seal arrangement having features in accordance with the present invention.

Referring now particularly to the drawing, the seal arrangement comprises a seal lid or flap 1 having an annular-shaped soft seal-insert 2 and a correspondingly formed steel seal-ring 3 which is arranged at the lowermost end of a gate 4. At the periphery, e.g. directed toward the wall 13 of the furnace proper, there is provided in the steel seal-ring 3 an annular groove 5. Metal-coated heating cables 6, providing for heating of the arrangement, are arranged in the annular groove 5 which heating cables 6 can be subjected to considerably high loads. Embedding of the heating cables 6 is further achieved by means of a heat-conducting cement, generally designated by the numeral 7. The cables 6 and the heat-conducting cement 7 are additionally retained by outer clamping bands 8. The heating cables 6 are furnished with "cold" ends 9 and flexible connecting cables 10. Since the steel seal-ring 3, which is to be heated, is located so as to be surrounded by the pertaining inner furnace atmosphere, the flexible connecting cables 10 are passed through a flange piece 11 and a cover 12 therefor, with the flange piece 11 being suitably secured to the furnace wall 13.

Between the cables 6 in groove 5 and the seal surface 14 two axial bores 15 are provided in the steel seal-ring 3, for operatively receiving therein temperature sensors 16. The temperature sensors 16 are connected by means of cables 17 which are also pressure-tight passed through the furnace wall 13 to an electronic control system, not shown, for continuously monitoring the temperature of the steel seal-ring 3. The heat input to maintain the steel seal-ring 3 at the desired temperature can then be continuously adjusted.

The arrangement in accordance with the present invention provides primarily for the advantage that, through heating of the steel seal-ring, condensation of gases at this ring will be avoided so that clinker formation of dust on the seal-ring is prevented as are irregularities of the seal surface between the steel-ring and the seal lid.

The present invention is, of course, in no way restricted to the specific disclosure of the specification and drawing, but also encompasses any modifications within the scope of the appended claims.

What we claim is:

1. Gate arrangement for counterpressure blast furnaces, comprising:

a seal lid having an annular soft seal-insert;

a gate having a steel seal-ring adapted to operatively contact at least said annular soft seal-insert of said lid at a seal surface; and heating means operatively connectible to said steel seal-ring about the periphery thereof.

2. Gate arrangement in accordance with claim 1, wherein said steel seal-ring includes an annular groove in the axial outer face thereof, and wherein said heating means is located in said annular groove.

3. Gate arrangement in accordance with claim 1, wherein said heating means includes metal-coated heating cables.

4. Gate arrangement in accordance with claim 1, wherein said heating means is embedded in a heat conducting cement.

5. Gate arrangement in accordance with claim 1, wherein said heating means is operatively retained by means of at least one clamping band.

6. Gate arrangement in accordance with claim 1, wherein said steel seal-ring includes at least one receiving bore arranged between said heating means and said seal surface, and further comprising temperature sensor means operatively arranged in said at least one receiving bore for determining the temperature at said seal surface.

* * * * *